US005445224A

United States Patent [19]

Comeaux

[11] Patent Number: 5,445,224

[45] Date of Patent: Aug. 29, 1995

[54] HYDROSTATIC CONTROL VALVE

[76] Inventor: Luther R. Comeaux, 9993 J. Torres Rd., P.O. Box 356, Maringouin, La. 70757

[21] Appl. No.: 299,310

[22] Filed: Sep. 1, 1994

[51] Int. Cl.[6] ..... E21B 34/10; E21B 37/00

[52] U.S. Cl. ..... 166/312; 137/102; 166/321; 166/325; 166/374

[58] Field of Search ..... 166/325, 321, 386, 312, 166/374; 137/102

[56] References Cited

U.S. PATENT DOCUMENTS

| | | | |
|---|---|---|---|
| Re. 28,588 | 10/1975 | Sizer et al. | 166/224 R |
| 2,252,418 | 8/1941 | Shelley | 137/102 |
| 2,864,449 | 1/1954 | Tausch | 166/115 |
| 2,959,225 | 2/1958 | Roberts | 166/147 |
| 3,040,710 | 6/1962 | Wilder | 166/325 X |
| 3,130,789 | 4/1964 | Alexander et al. | 166/325 X |
| 3,409,078 | 11/1968 | Knox et al. | 166/374 |
| 3,698,426 | 10/1972 | Litchfield et al. | 166/325 X |
| 3,905,382 | 9/1975 | Waterston | 137/102 |
| 3,987,848 | 10/1976 | Canterbury | 166/324 A |
| 4,257,484 | 3/1981 | Whitley et al. | 166/325 |
| 4,260,020 | 4/1981 | Nelson et al. | 166/312 X |
| 4,270,569 | 6/1981 | Reay et al. | 166/325 X |
| 4,279,306 | 7/1981 | Weitz | 166/312 |
| 4,421,174 | 12/1983 | McStravick et al. | 166/374 |
| 4,431,051 | 2/1984 | Adams, Jr. | 166/72 |
| 4,562,854 | 1/1986 | Pringle et al. | 137/135 |
| 5,056,599 | 10/1991 | Comeaux et al. | 166/310 |
| 5,332,042 | 7/1994 | Walter et al. | 166/321 |

*Primary Examiner*—Hoang C. Dang
*Attorney, Agent, or Firm*—David L. Ray

[57] ABSTRACT

The present invention provides a method and apparatus for controlling the flow of fluids being injected into an oil or gas well through a tubing string, including a generally cylindrical hollow body for connection to the tubing string for receiving and selectively conveying fluids received from the tubing string therethrough, the body having an open top end and an open bottom end, the body having a flow passage therein for conveying fluids from the top end of the hollow body to the bottom end of the hollow body, the top end being provided with a device for connecting the top end to the tubing string, the bottom end being provided with a device for connecting the bottom end to a tool for injecting the fluids into a well, a movable piston slidably received in the body, the movable piston being movable upward against a top seal to stop the flow of fluids through the flow passage and being movable downward against a stop to enable fluids to flow through the flow passage from the top end to the bottom end in response to sufficient hydraulic pressure being applied to the fluids in the tubing string, a biasing device contained inside the body for biasing the piston toward the top end of the body to stop the conveyance of fluids through the flow passage, and a port located beneath the piston for conveying fluids contained in the body beneath the piston to the exterior of the body when the piston is forced against the top seal, the port being closed by the piston when the piston is forced downward against the stop.

20 Claims, 6 Drawing Sheets

HYDROSTATIC CONTROL VALVE

BACKGROUND OF THE INVENTION

1. Field of the Invention

The present invention relates to tools used in petroleum and gas wells. More particularly, the present invention is related to washing tools used when injecting treating fluids such as cleaning fluids into petroleum and gas wells which have depleted or low bottom hole pressure to clean the producing area of the well to increase bottom hole pressure and improve flow from the well. Even more particularly, the present invention is related to control valves used in petroleum and gas wells.

2. Description of the Related Art

In oil and gas wells that have been depleted or have low bottom hole pressure and were gravel packed when completed, it is known to inject cleaning fluids in the well to clean the gravel pack area of the well and/or the perforations in the casing to improve bottom hole pressure and improve flow from the well. Frequently, the cleaning fluids will seek the path of least resistance and clean out one to three feet of the perforated area of the tubing or casing in the well and the remainder of the perforated area are never contacted by the cleaning fluids and acid.

To prevent this from happening and to make sure every foot of the perforations get treated with cleaning fluids, it is known to insert tools having dual packer assemblies with injection ports between the packings in the well. The dual packer assemblies are actuated when pressure is applied from the surface to isolate the portion of the perforations to be treated. Exemplary of such tools having dual element packings is U.S. Pat. No. 4,279,306 issued Jul. 21, 1981 which is hereby incorporated by reference.

Occasionally, even when using washing tools having dual packer elements, cleaning fluids will escape to the surrounding strata, and large volumes of expensive cleaning fluid will be lost. All of the cleaning fluid in the tubing above the dual packer assemblies may be lost to the surrounding strata. If, for example, a gravel pack and/or casing perforations were being washed at a 10,000 foot depth, and tubing having a 1.25 inch diameter were being used, about 50 barrels of cleaning fluid costing several hundred dollars per barrel may drain from the tubing into the surrounding strata and be lost.

Furthermore, when fluid is being lost to the surrounding strata, the pressure between the dual packing elements drops below the pressure of the fluids above the top packer assembly between the washing tool and the casing, or production string inside the casing. Such pressure differential on each side of the top packer may lock the top packer assembly in the expanded position and prevent removal of the washing tool from the hole.

Exemplary of the patents of the prior art are U.S. Pat. Nos. 5,056,599; 4,562,854; 4,431,051; 4,421,174; 4,279,306; 4,257,484; 3,987,848; 2,959,225; 2,864,449; and Re. 28,588.

SUMMARY OF THE INVENTION

In accordance with the present invention there is provided a method and apparatus for controlling the flow of fluids being injected into an oil or gas well through a tubing string, including a generally cylindrical hollow body for connection to the tubing string for receiving and selectively conveying fluids received from the tubing string therethrough, the body having an open top end and an open bottom end, the body having a flow passage therein for conveying fluids from the top end of the hollow body to the bottom end of the hollow body, the top end being provided with a device four connecting the top end to the tubing string, the bottom end being provided with a device for connecting the bottom end to a tool for injecting the fluids into a well, a movable piston slidably received in the body, the movable piston being movable upward against a top seal to stop the flow of fluids through the flow passage and being movable downward against a stop to enable fluids to flow through the flow passage from the top end to the bottom end in response to sufficient hydraulic pressure being applied to the fluids in the tubing string, a biasing device contained inside the body for biasing the piston toward the top end of the body to stop the conveyance of fluids through the flow passage, and a port located beneath the piston for conveying fluids contained in the body beneath the piston to the exterior of the body when the piston is forced against the top seal, the port being closed by the piston when the piston is forced downward against the stop.

The present invention has the advantage preventing overtreatment of depleted wells.

The present invention has the further advantage of preventing loss of treatment fluids.

The present invention has the additional advantage of preventing washing tools from being stuck in a well.

Furthermore, the present invention can eliminate the need for expensive workover rigs to used to wash and clean oil and gas wells.

DESCRIPTION OF THE PREFERRED EMBODIMENTS

Figure 1A:
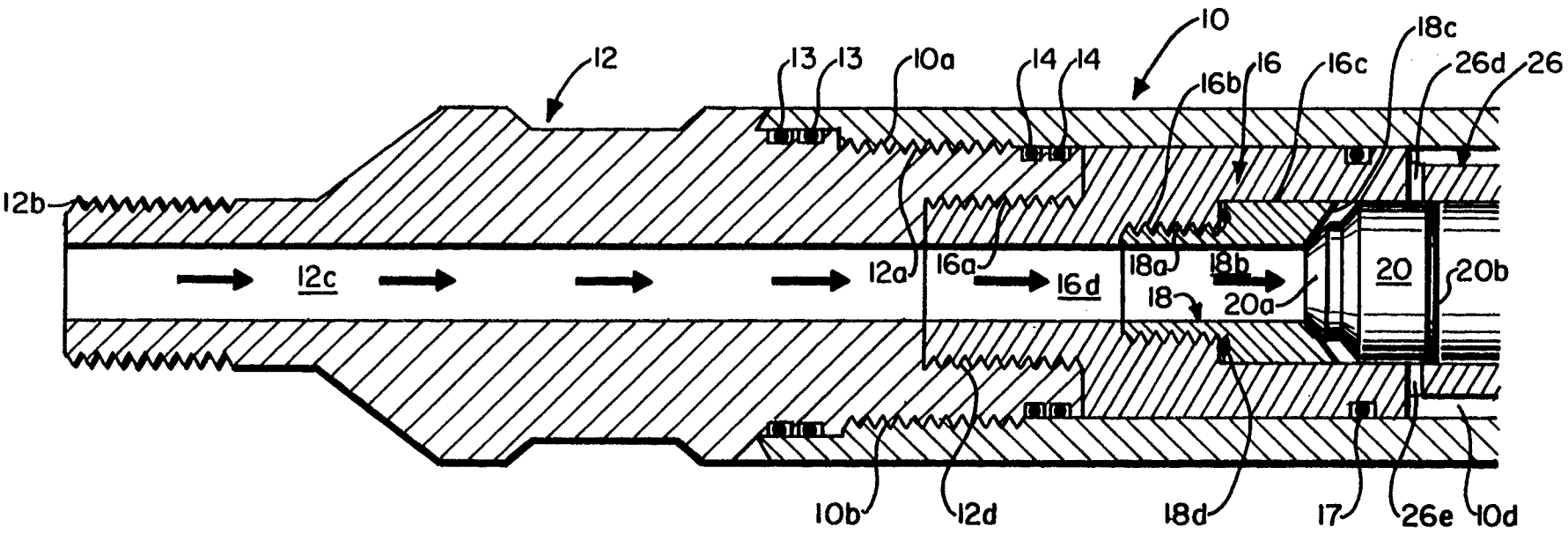
FIG. 1A is an elevational view, partly cross-sectional, of the top portion of the valve of the invention in the closed position.
Figure 1B:
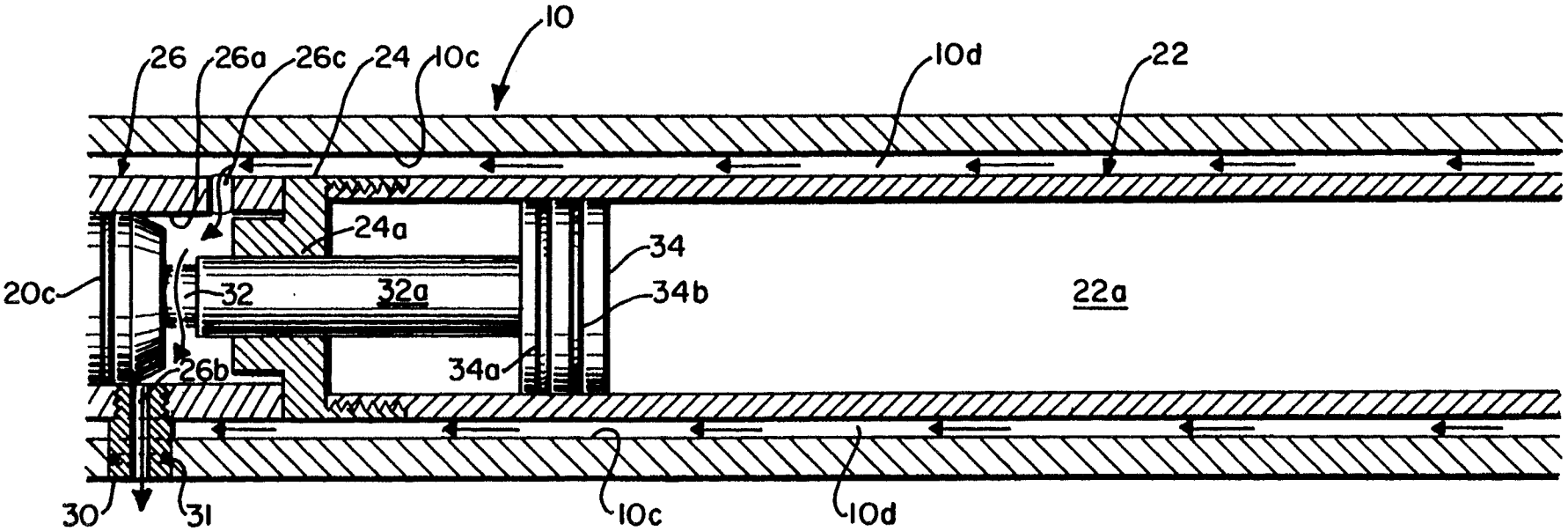
FIG. 1B is an elevational view, partly cross-sectional, of the middle portion of the valve of the invention in the closed position.
Figure 1C:
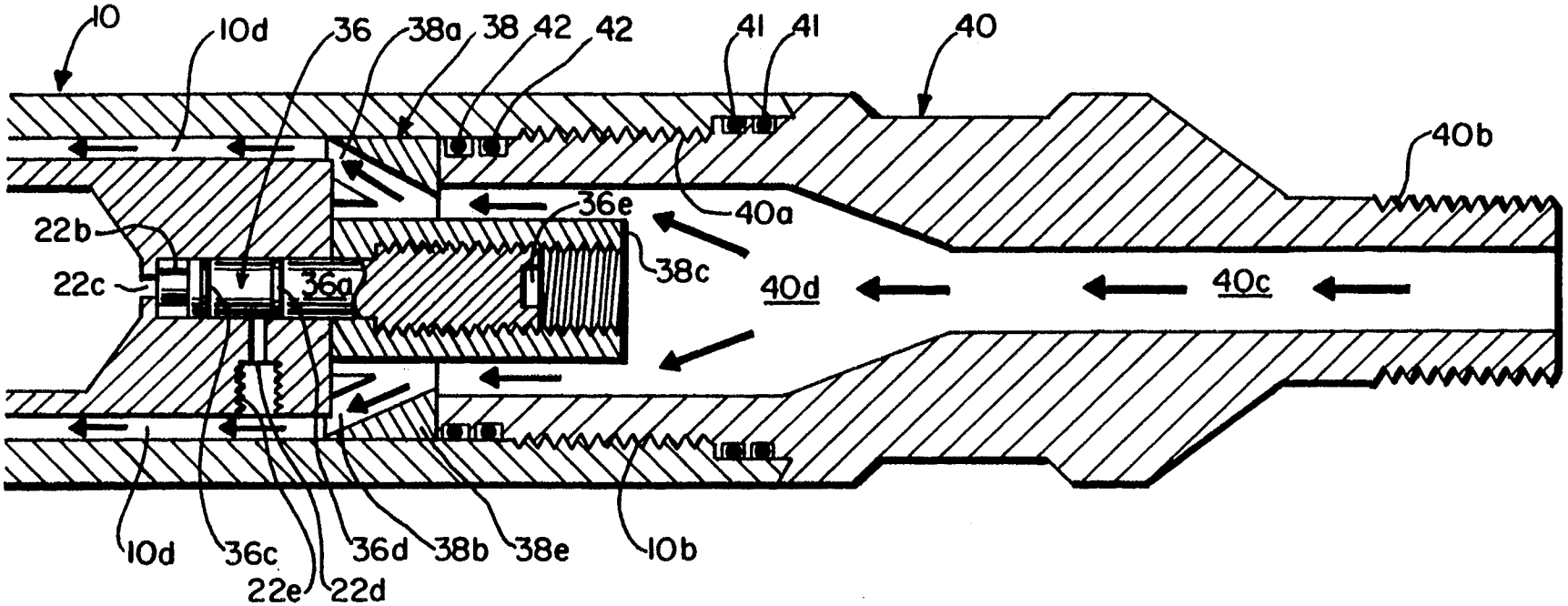
FIG. 1C is an elevational view, partly cross sectional of the bottom portion of the valve of the invention in the closed position.
Figure 2A:
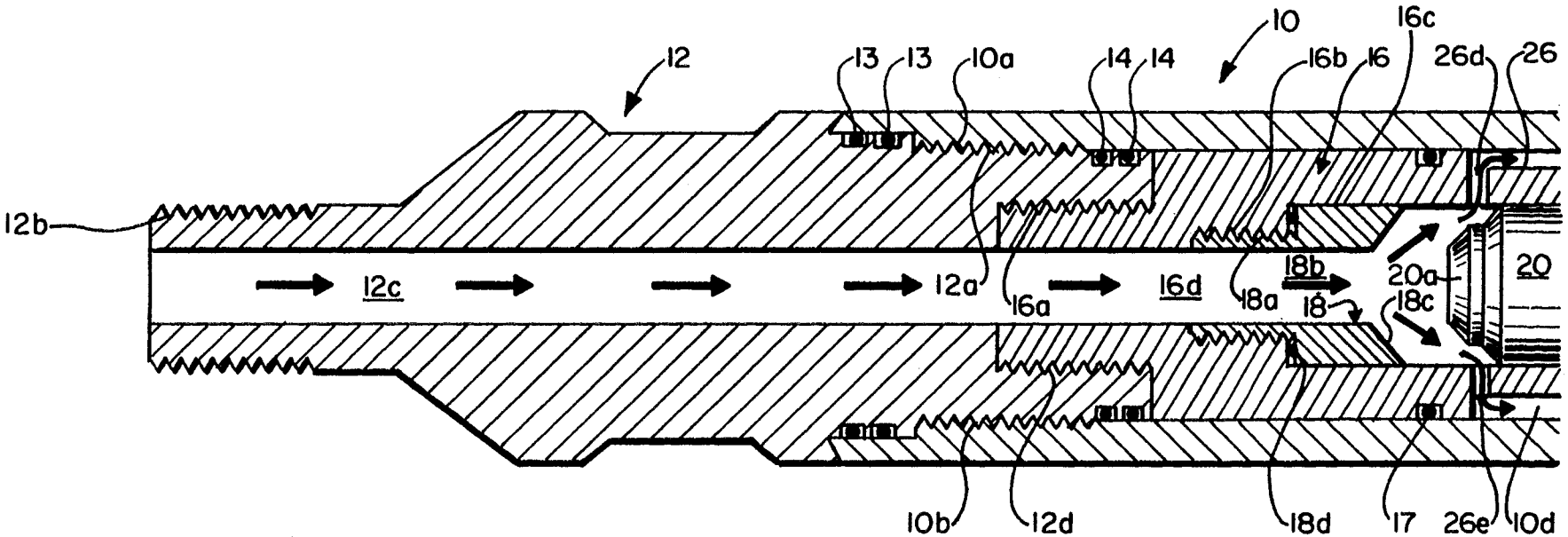
FIG. 2A is an elevational view, partly cross-sectional, of the top portion of the valve of the invention in the open position.
Figure 2B:
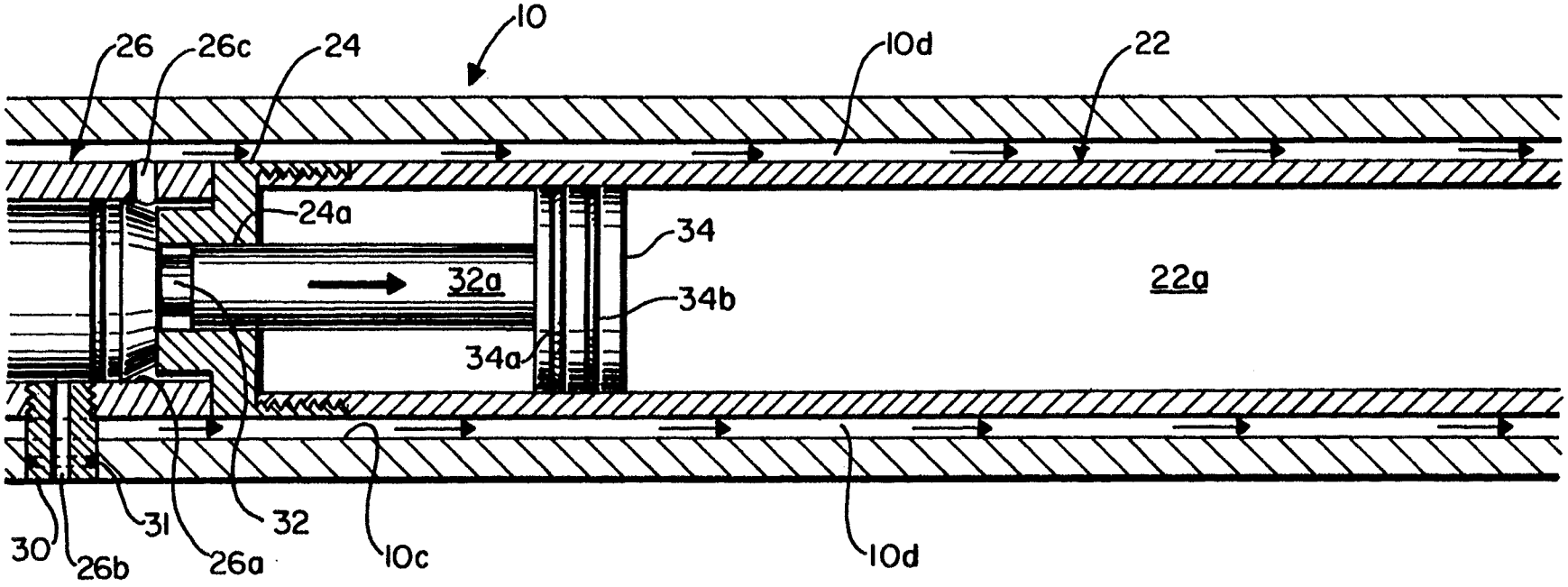
FIG. 2B is an elevational view, partly cross-sectional, of the middle portion of the valve of the invention in the open position.
Figure 2C:
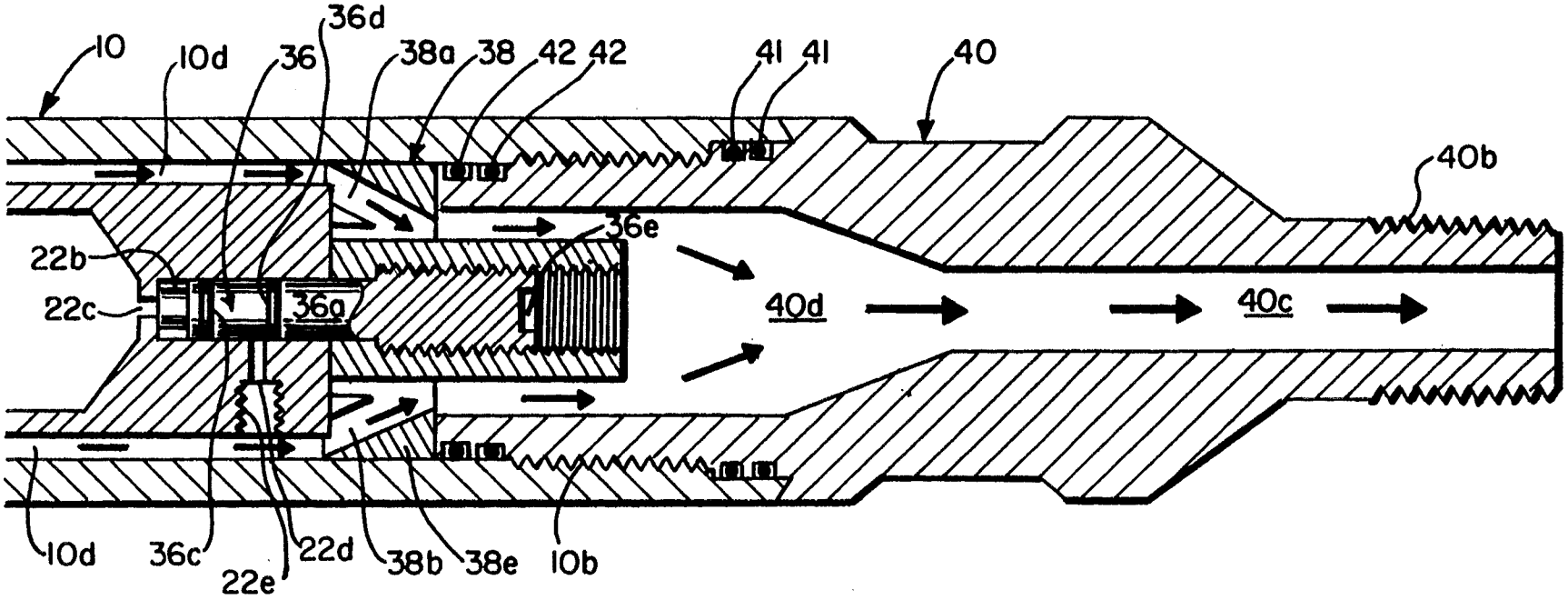
FIG. 2C is an elevational view, partly cross sectional of the bottom portion of the valve of the invention in the open position.

Referring now to the drawings, the control valve assembly of the invention is shown in the closed position in FIGS. 1A, 1B, and 1C, and the valve assembly of the invention is shown in the open position in FIGS. 2A, 2B, and 2C. FIGS. 1A, 1B, and 1C are each portions of one continuous valve assembly or tool of the invention in the closed position, FIG. 1A being the top portion of the tool, FIG. 1B being the middle portion of the tool, and FIG. 1C being the bottom portion of the tool. FIGS. 2A, 2B, and 2C are each portions of the same continuous valve assembly or tool of the invention in the open position, FIG. 2A being the top portion of the tool, FIG. 2B being the middle portion of the tool, and FIG. 2C being the bottom portion of the tool. Arrows on the FIGS. 1A, 1B, and 1C indicate flow of fluids in the valve assembly when the valve assembly is in the closed position and the valve assembly is being lowered into tubing or casing containing fluids such as oil and gas, and arrows on the FIGS. 2A, 2B, and 2C indicate flow of fluids in the valve assembly when the valve assembly is in the open position and fluids are being forced through the valve assembly of the invention.

The top end of the control valve assembly of the present invention connects to conventional tubing or conventional coil tubing which is inserted into the production string fitted inside the well casing. The control valve assembly of the invention can also be connected to tubing inserted into the casing in a well.

Referring now to the drawings, the control valve assembly of the invention can be seen to include a hollow cylindrical body 10 having female threads 10*a* at the top and female threads 10*b* at the bottom.

A top sub generally indicated by the numeral 12 having bottom male threads 12*a* is threadably connected to hollow cylindrical body 10 by threading male threads 12*a* into female threads 10*a* of body 10. Seals such as elastic or rubber O-rings 13—13 and 14—14 may be provided in grooves on top sub 12 if desired, for sealing in addition to the seal provided by the threads 10*a* and 12*a*. Top sub 12 is provided with male threads 12*b* on the top end thereof for connecting top sub 12 to tubing (not shown) inserted into a well and extending from the surface to top sub 12. Top sub 12 has a central flow passage 12*c* therein for conveying fluids received from tubing connected to threads 12*b* therethrough. Top sub 12 also has female threads 12*d* centrally located therein at the bottom thereof.

A cylindrical primary piston seat sub generally indicated by the numeral 16 having male threads 16*a* on the top end thereof is slidably received inside body 10 and threadably connected to top sub 12 by threading male threads 16*a* into female threads 12*d* of top sub 12. Primary piston seat sub 16 preferably has an O-ring 17 therein for providing an additional seal between the primary piston seat sub 16 and the inside wall 10*c* of body 10. Primary piston seat sub 16 has female threads 16*b* at the lower end thereof and a central cylindrical bore 16*c* adjacent to and beneath female threads 16*b*. Primary piston seat sub 16 has a central flow passage 16*d* therein for conveying fluids received from central flow passage 12*c* therethrough.

A primary piston seat generally indicated by the numeral 18 having male threads 18*a* on the top end thereof is threadably connected to primary piston seat sub 16 by threading male threads 18*a* into female threads 16*b* of primary piston seat sub 16. Primary piston seat 18 has a central flow passage 18*b* therein for conveying fluids received from central flow passage 16*d* therethrough. Primary piston seat 18 is fitted inside cylindrical bore 16*c* and has beveled edge 18*c* on the lower end thereof surrounding central flow passage 18*b*. An O-ring 18*d* is located between piston seat 18 and primary piston seat sub 16.

A cylindrical primary piston generally indicated by the numeral 20 is shown in FIGS. 1A, 1B, and 1C to be slidably received partially in cylindrical bore 16*c* of primary piston seat sub 16. Primary piston 20 has a beveled top end 20*a* which makes a sealing contact with beveled edge 18*c* of primary piston seat 18 when primary piston 20 is forced against beveled edge 18*c*.

A hollow cylindrical gas chamber body 22 is located inside of body 10 beneath piston seat sub 16 and piston seat 18. Gas chamber body 22 is smaller in outside diameter than the inside diameter of wall 10*c* to form a hollow cylindrical annulus 10*d* between the outside of gas chamber body 22 and the inside wall 10*c* of body 10 through which fluids may flow as indicated by the arrows.

Gas chamber body 22 has a cap 24 threaded to the upper end thereof. A hollow cylindrical piston sleeve 26 is rigidly connected by welding or the like to cap 24 for slidable receipt of piston 20. Piston sleeve 26 butts against primary piston seat sub 16. Piston 20 has two O-rings 20*b* and 20*c* thereon for forming a sliding seal with the inside wall 26*a* of piston sleeve 26. Piston sleeve 26 has threadably connected thereto a threaded bleed port 30 which is rigidly connected to body 10 and has port 26*b* therein, to enable fluids to enter and exit through port 26*b* from the inside of wall 26*a* beneath piston 20 to the exterior of body 10. Threaded bleed port 30 may have an O-ring 31 thereon to form a seal with cylindrical body 10. Piston sleeve 26 has a bottom port 26*c* which permits fluids to enter and exit from the inside of wall 26*a* beneath piston 20 to the exterior of sleeve 26. Piston sleeve 26 has at least two, preferably eight to twelve aligned circularly around piston sleeve 26, ports 26*d* and 26*e* at the top end thereof. It is important that O-ring 20*b* be positioned on piston 20 so that O-ring 20*b* will be located below ports 26*d* and 26*e* when piston 20 is in the closed position shown in FIGS. 1A and 1B, and above port 26*b* when piston 20 is in the open position shown in FIGS. 2A and 2B to maintain the flow path of fluids indicated by the arrows in FIGS. 1A, 1B, and 1C, and in FIGS. 2A, 2B, and 2C. Furthermore, it is important that O-ring 20*c* be positioned on piston 20 so that O-ring 20*c* will be located above ports 26*d* and 26*e* when piston 20 is in the closed position shown in FIGS. 1A and 1B, and O-ring 20*c* will be located below port 26*b* when piston 20 is in the open position shown in FIGS. 2A and 2B to maintain the flow path of fluids indicated by the arrows in FIGS. 1A, 1B, and 1C, and in FIGS. 2A, 2B, and 2C.

Rigidly connected to the bottom of piston 20 is first connecting rod 32 which is also rigidly connected to second cylindrical connecting rod 32*a* which is larger in diameter than first connecting rod 32 and axially aligned therewith. If desired, first and second connecting rods 32 and 32*a* could be combined in one cylindrical connecting rod of uniform diameter. Connecting rod 32*a* is slidably received in a hollow cylindrical bore 24*a* centrally located in cap 24. Cap 24 limits the downward movement of piston 20 as shown in FIG. 2B.

A secondary cylindrical piston 34 is rigidly connected to connecting rod 32*a* and is slidably received in hollow cylindrical gas chamber 22*a* centrally located in gas chamber body 22. Secondary piston 34 preferably has two O-rings 34*a* and 34*b* for forming a sliding seal with the inside wall of gas chamber 22*a*. Gas chamber 22*a* contains preferably an inert gas such as nitrogen under superatmospheric pressure which biases or forces secondary piston 34 and primary piston 20 upward.

At the lower end of gas chamber 22*a* and gas chamber body 22 is a charge valve generally indicated by the numeral 36. Charge valve 36 has a cylindrical portion 36*a* which is slidably fitted into a central cylindrical bore 22*b* centrally located in the bottom end of gas chamber body 22, and charge valve 36 has a threaded generally cylindrical portion 36*b* integrally formed with cylindrical portion 36*a* having male threads thereon. Gas chamber body 22 has a cylindrical port 22*c* adjacent to cylindrical bore 22*b* which communicates with gas chamber 22*a*. Charge valve 36 preferably has two O-rings 36*c* and 36*d* therearound to provide a seal between charge valve 36 and central cylindrical bore 22*b*.

A lower port 22*d* is located in the bottom end of gas chamber body 22 and is connected to cylindrical bore 22*b*. Lower port 22*d* has female threads 22*e* adjacent thereto for filling gas chamber 22*a* with gas under superatmospheric pressure when valve 36 is moved downward sufficiently to permit gas entering port 22*d* to flow through cylindrical bore 22*b* and cylindrical port 22*c*.

A generally cylindrical spacer ring generally indicated by the numeral 38 is rigidly connected to the bottom of gas chamber body 22 by welding or the like and slidably fits inside of wall 10*c* of body 10. Spacer ring 38 has two or more ports 38*a* and 38*b* therein. Spacer ring 38 has a threaded cylindrical portion 38*c* having female threads therein which threadably receive threaded portion 36*b* of charge valve 36. A slot 36*e* for receipt of a screw driver or other tool for turning charge valve 36 to position charge valve 36 for filling gas chamber 22*a* with gas through port 22*d*. If desired, a cavity for receipt of an Allen wrench or the like could be substituted for slot 36*e*. Spacer ring 38 also has a cylindrical base 38*e* which is slidably received inside wall 10*c* of body 10 and rests against the inside wall 10*c* of body 10.

A bottom sub 40 having male threads 40*a* on the top end thereof is threadably connected to hollow cylindrical body 10 by threading male threads 40*a* into female threads 10*b* of body 10. Seals such as O-rings 41—41 and 42—42 may be provided, if desired, for sealing in addition to the seal provided by the threads 10*b* and 40*a*. Bottom sub 40 is provided with male threads 40*b* for connecting bottom sub 40 to a washing tool such as that disclosed in U.S. Pat. No. 4,279,306 or any other desired washing tool, or to any other oil or gas well tool desired. Bottom sub 40 has a central flow passage 40*c* therein for conveying fluids received from a tool which may be connected to threads 40*b* therethrough as shown by the arrows in FIGS. 1A, 1B, or 1C, or to receive fluids from annulus 10*d* as shown by the arrows in FIGS. 2A, 2B, and 2C. Bottom sub 40 has a central cylindrical chamber 40*d* for containing threaded cylindrical portion 38*c* of spacer 38, and for receiving liquids flowing through bottom sub 40.

OPERATION OF THE INVENTION

To use the control valve assembly of the present invention, gas chamber 22*a* is filled with gas as described above of the desired pressure. The pressure of the gas in gas chamber is determined by the depth at which the control valve assembly is to be operated and must be sufficient to force piston 20 to the closed position shown in FIGS. 1A, 1B, and 1C when the tubing above top sub 12 is filled with the liquids to be injected into the well through the control valve assembly of the invention.

The control valve assembly of the invention is then assembled as indicated above and in the drawings, and top sub 12 is connected to the tubing to be inserted into the well by threadably connecting threads 12*b* to the tubing to be inserted into the well. Next, any desired tool such as a washing tool described above is threadably connected to bottom sub 40 by threadably connecting threads 40*b* to the tool to be inserted into the well.

The control valve and the invention and the tool connected thereto are then lowered into the well by lowering the tubing connected to top sub 12 into the well to the desired depth or location in the well to be treated. As the control valve assembly of the invention is being lowered into the well, fluids contained in the well can flow through the tool connected to bottom sub 40 as indicated by the arrows upward through central flow passage 40*c*, cylindrical chamber 40*d*, ports 38*a* and 38*b*, annulus 10*d*, port 26*c*, inside wall 26*a* of sleeve 26, and out of port 26*b* to the exterior of body 10.

When the tool connected to bottom sub 40 reaches the desired depth in the well, the descent of the tool within the well is stopped, and pressure is applied to the liquid in the tubing connected to top sub 12 by a pump on the surface sufficient to force primary piston 10 and connecting rods 32 and 32*a*, and secondary piston 34 to the open position shown in FIGS. 2A, 2B, and 2C, thereby sealing port 26*b*. Liquids contained in the tubing above top sub 12 will then flow as indicated by the arrows in FIGS. 2A, 2B, and 2C through central flow passage 12*c*, central flow passage 16*d*, central flow passage 18*b*, through ports 26*d* and 26*e*, annulus 10*d*, ports 38*a* and 38*b*, chamber 40*d*, and out of central passage 40*c* to the tool which may be connected to threads 40*b* of bottom sub 40.

If more fluids begin to exit from sub 40 than desired, such as when using a washing tool through which cleaning fluids are escaping to the surrounding strata, the pressure applied at the surface to the liquids contained in the tubing connected to top sub 12 is decreased sufficiently for the pressure of the gas in gas chamber 22*a* to force piston 20 to the closed position shown in FIGS. 1A, 1B, and 1C. Thus, the flow of liquids is stopped, thereby stopping the loss of liquids to the surrounding strata.

An important additional advantage of the present invention is realized when the invention is connected to a washing tool having dual packer elements such as that described in U.S. Pat. No. 4,279,306 or the like (if the washing tool of U.S. Pat. No. 4,279,306 were used, ball B would be placed in the washing tool prior to connection to the control valve assembly of the invention). When fluid is being lost to the surrounding strata from such a washing tool having dual packer elements, the pressure between the dual packing elements drops below the pressure of the fluids above the top packer assembly between the washing tool and the casing, or between the washing tool and production string inside the casing. Such pressure differential on each side of the top packer may lock the top packer assembly in the expanded position and prevent removal of the washing tool from the hole. If the present invention is connected above such a washing tool, surface pressure on the liquids in the tubing connected to top sub 12 is reduced sufficiently to move piston 20 to the closed position shown in FIGS. 1A, 1B, and 1C, and the liquids contained in the casing or production tubing in which the washing tool and the control valve assembly of the present invention are located will flow from the exterior of body 10 through port 26*b*, into the inside wall 26*a* of sleeve 26, through port 26*c* into annulus 10*d*, through ports 38*a* and 38*b* into chamber 40*d*, and into central passage 40*c* to the washing tool connected to bottom sub 40, and through the washing tool into the space between the expanded packers in the washing tool, thereby equalizing the pressure on the top and bottom of the top packer on the washing tool, permitting the packer to contract, enabling the washing tool to be withdrawn from the well.

Although the preferred embodiments of the invention have been described in detail above, it should be understood that the invention is in no sense limited thereby, and its scope is to be determined by that of the following claims:

What is claimed is:

1. A hydraulically actuated control valve assembly for location in a tubing string for controlling the flow of fluids being injected into an oil or gas well through the tubing string, said control valve assembly comprising:

a. generally cylindrical hollow body means for connection to said tubing string for receiving and selectively conveying fluids received from said tubing string therethrough, said body means having an open top end and an open bottom end, said body means having a flow passage therein for conveying fluids from said top end of said hollow body means to said bottom end of said hollow body means, said top end being provided with means for connecting said top end to said tubing string, said bottom end being provided with means for connecting said bottom end to a tool for injecting said fluids into a well, b. a movable piston slidably received in said body means, said movable piston being movable upward against a top seal to stop the flow of fluids through said flow passage and being movable downward against a stop to enable fluids to flow through said flow passage from said top end to said bottom end in response to sufficient hydraulic pressure being applied to said fluids in said tubing string, c. biasing means contained inside said body means for biasing said piston toward said top end of said body means to stop the conveyance of fluids through said flow passage, and d. port means located beneath said piston for conveying fluids contained in said body means beneath said piston to the exterior of said body means when said piston is forced against said top seal, said port means being closed by said piston when said piston is forced downward against said stop.

2. The control valve assembly of claim 1 wherein said biasing means comprises a gas chamber having a second piston therein.

3. The control valve assembly of claim 2 wherein said second piston is rigidly connected to said movable piston.

4. The control valve assembly of claim 3 wherein said gas chamber is generally cylindrical in shape.

5. The control valve assemble of claim 4 wherein said gas chamber is filled with an inert gas.

6. The control valve assembly of claim 1 wherein said piston is slidably received in a hollow cylindrical sleeve rigidly connected to the inside of said body means.

7. The control valve assembly of claim 6 wherein said port means extends through said sleeve and said body means.

8. The control valve assembly of claim 7 wherein said sleeve has second port means therein for conveying fluids from inside said body means to the inside of said hollow cylindrical sleeve when said piston is forced upward against said top seal.

9. The control valve assembly of claim 8 wherein said flow passage forms an annulus around said sleeve.

10. The control valve assembly of claim 9 wherein said sleeve has third port means therein for conveying fluids to said annulus when said piston is forced downward against said stop.

11. The control valve assembly of claim 9 wherein said biasing means comprises hollow cylindrical gas chamber means having a second piston therein which is rigidly connected to said movable piston.

12. The control valve assembly of claim 11 wherein said sleeve is axially aligned with said gas chamber.

13. The control valve assembly of claim 12 wherein said sleeve is rigidly connected to said gas chamber.

14. The control valve assembly of claim 13 wherein said flow passage forms an annulus around said gas chamber.

15. The control valve assembly of claim 14 wherein said gas chamber has valve means therein for filling said gas chamber with gas under superatmospheric pressure.

16. The control valve assembly of claim 1 wherein said piston has seal means thereon for preventing fluids from flowing through said port means when said piston is forced against said stop.

17. The control valve assembly of claim 16 wherein said seal means are O-rings.

18. A method for controlling the flow of fluids being injected through a tubing string into a washing tool in an oil or gas well comprising:

a. attaching a valve assembly to the bottom end of said tubing string, b. attaching a washing tool to the lower end of said valve assembly, c. lowering said valve assembly and washing tool into said well to the desired depth, d. biasing said valve assembly to close and prevent fluids from flowing from said tubing through said valve assembly into said washing tool until a preset pressure applied to the fluids in said tubing string is exceeded, and e. providing a flow passage from said washing tool through said valve assembly to the outside of said valve assembly when said valve assembly is biased closed to enable fluids to flow from said washing tool beneath said valve assembly through said valve assembly and to the exterior of said valve assembly and tubing when the pressure on said fluids in said washing tool exceeds the pressure of fluids on the exterior of valve assembly and above said tool, and to enable fluids on the outside of said valve assembly to flow into said valve assembly and into said washing tool beneath said valve assembly when the pressure on said fluids on the exterior of said valve assembly exceeds the pressure of fluids inside said washing tool.

19. The method of claim 18 wherein sufficient pressure is applied to said fluids in said tubing to force said valve assembly open and close said flow passage for fluids inside said valve assembly to the exterior of said valve assembly, thereby permitting fluids to flow from said tubing through said valve assembly to said washing tool.

20. The method of claim 19 wherein said valve assembly is biased toward the closed position by gas under superatmospheric pressure contained is said valve assembly.

* * * * *